US010670327B1

(12) United States Patent
Haenssler et al.

(10) Patent No.: US 10,670,327 B1
(45) Date of Patent: Jun. 2, 2020

(54) HOUSEHOLD COOLING APPLIANCE COMPRISING A SHELF DEVICE

(71) Applicant: BSH HAUSGERAETE GMBH, Munich (DE)

(72) Inventors: Felix Haenssler, Langenau (DE); Andrea Fink, Gerstetten (DE); Juergen Fink, Gerstetten (DE); Bernd Pfister, Heidenheim (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/212,948

(22) Filed: Dec. 7, 2018

(51) Int. Cl.
*F25D 25/02* (2006.01)
*F25D 11/00* (2006.01)
*F25D 23/06* (2006.01)

(52) U.S. Cl.
CPC ..... *F25D 25/02* (2013.01); *F25D 11/00* (2013.01); *F25D 23/067* (2013.01)

(58) Field of Classification Search
CPC ..... F25D 25/02; F25D 23/067; F25D 11/00
See application file for complete search history.

(56) References Cited

U.S. PATENT DOCUMENTS 5,340,209 A * 8/1994 Kolbe ..... F25D 25/024 312/334.46
5,441,338 A * 8/1995 Kane ..... A47B 96/025 108/159
5,540,493 A * 7/1996 Kane ..... A47B 57/16 211/153
5,564,809 A * 10/1996 Kane ..... A47B 57/16 211/193
6,120,720 A * 9/2000 Meier ..... B29C 45/14377 264/261
8,979,225 B2 3/2015 Eckartsberg et al.
9,816,746 B1 * 11/2017 Haney ..... F25D 11/00
2002/0190620 A1 * 12/2002 Vardon ..... A47B 96/021 312/408
2003/0222043 A1 * 12/2003 Rouch ..... A47B 96/062 211/153
2005/0017143 A1 * 1/2005 Bronsink ..... F25D 25/02 248/250
2005/0204966 A1 * 9/2005 Bienick ..... A47B 57/48 108/108
2005/0258725 A1 * 11/2005 Jang ..... F25D 25/024 312/408

(Continued)

FOREIGN PATENT DOCUMENTS

EP 1431688 A1 * 6/2004 ..... A47B 73/00
WO 2008095780 A2 8/2008

*Primary Examiner* — Hanh V Tran
(74) *Attorney, Agent, or Firm* — Laurence A. Greenberg; Werner H. Stemer; Ralph E. Locher

(57) ABSTRACT

A household cooling appliance has a housing with a receiving space for food. A shelf bottom device is non-destructively releasably positioned in the receiving space. The shelf bottom device has a plate-like shelf bottom and a carrier unit that is separate therefrom. The carrier unit is connected with the shelf bottom and is configured for retention of the shelf bottom device in the receiving space. The shelf bottom device has at least one receiving element with a hollow space, which is arranged on the shelf bottom. In the mounted final state, the carrier unit is introduced at least partly in the hollow space.

12 Claims, 5 Drawing Sheets

(56) References Cited

U.S. PATENT DOCUMENTS

2006/0145577 A1* 7/2006 Daley ..... A47B 96/021 312/408
2007/0284985 A1* 12/2007 Wing ..... F25D 25/024 312/408
2008/0164797 A1* 7/2008 Kim ..... F25D 25/02 312/408
2009/0084914 A1* 4/2009 Picken ..... F25D 23/067 248/206.5
2010/0001625 A1* 1/2010 Eckartsberg ..... A47B 57/42 312/408
2010/0026156 A1* 2/2010 Leconte ..... A47B 96/021 312/408
2011/0079039 A1* 4/2011 Lim ..... B29C 65/08 62/465
2011/0089800 A1* 4/2011 Nash ..... A47B 96/028 312/404
2011/0115356 A1* 5/2011 Nash ..... A47B 96/021 312/408
2011/0164399 A1* 7/2011 Driver ..... A47B 57/42 362/92
2013/0106274 A1* 5/2013 Yang ..... F25D 23/067 312/404
2013/0277323 A1* 10/2013 Cheong ..... F25D 23/00 211/119.003
2014/0239792 A1* 8/2014 Chellappan ..... F25D 23/067 312/408
2014/0252937 A1* 9/2014 Lee ..... F25D 25/02 312/404
2014/0375199 A1* 12/2014 Lee ..... F25D 25/024 312/404
2015/0023000 A1* 1/2015 Kendall ..... F25D 25/02 362/92
2015/0253064 A1* 9/2015 Kim ..... F25D 25/02 312/408
2017/0214277 A1* 7/2017 Lee ..... H02J 50/12
2017/0234605 A1* 8/2017 Pfister ..... A47B 57/16 312/408
2017/0314847 A1* 11/2017 Ozyuksel ..... F25D 23/067
2017/0343276 A1* 11/2017 Cheon ..... A47B 57/30
2017/0363347 A1* 12/2017 Schenkl ..... F25D 23/062
2018/0058750 A1* 3/2018 Rotter ..... F25D 25/02
2018/0087828 A1* 3/2018 Park ..... F25D 17/062
2018/0100686 A1* 4/2018 Cizik ..... F25D 23/067

* cited by examiner

HOUSEHOLD COOLING APPLIANCE COMPRISING A SHELF DEVICE

BACKGROUND OF THE INVENTION

Field of the Invention

The invention relates to a household cooling appliance with a housing, which comprises a receptacle for food. Moreover the household cooling appliance comprises a shelf bottom device, which is non-destructively releasably attachable to the receptacle.

From the WO 2008/095780 A2 a refrigeration device is known. This cooling appliance comprises a shelf bottom, which is configured as plate. This shelf bottom is arranged in a cooling compartment of the refrigeration device. The shelf bottom is connected with two longitudinal carrier elements. These carrier elements are suspended from vertically oriented rails. The shelf bottom can be placed loosely onto these carrier elements that are configured as carrier arms. Moreover it may be envisaged that the shelf bottom is surrounded by a frame and these carrier arms are configured to be integrally formed with the frame.

BRIEF SUMMARY OF THE INVENTION

It is the object of the present invention to provide a shelf bottom device and a household cooling appliance, in which for instance the capability to be handled is enhanced.

This and other objects is solved by the independent claims.

One aspect of the invention relates to a household cooling appliance. The household cooling appliance comprises a housing, in which at least one receptacle for food is formed. The household cooling appliance moreover comprises a shelf bottom device. This shelf bottom device is non-destructively releasably positionable in the receptacle. The shelf bottom device comprises a plate-like shelf bottom. Moreover the shelf bottom device comprises a carrier unit that is separate therefrom. The carrier unit is connected with the shelf bottom. Moreover the carrier unit for retention of the shelf bottom device is formed in the receptacle. The shelf bottom device has at least one receiving element. This receiving element comprises a hollow space. The receiving element is arranged on the shelf bottom, wherein in the mounted final state this carrier unit is at least partly introduced into the hollow space.

Independently of the above-named household cooling appliance one further aspect of the invention also relates to a shelf bottom device for a household cooling appliance, wherein the shelf bottom device comprises the components assigned to it, as set out in the above, in particular advantageous embodiments thereof are provided in particular through the features set out in the following.

Embodiments of the invention are explained in more detail in the following on the basis of schematic drawings.

BRIEF DESCRIPTION OF THE SEVERAL VIEWS OF THE DRAWING

In the figures identical or functionally identical elements are identified with the same reference signs.

DETAILED DESCRIPTION OF PREFERRED EMBODIMENTS

With indications "top", "bottom", "front", "back", "horizontal", "vertical", "depth direction", "width direction", "height direction" etc. the positions and orientations given in the case of intended use and intended arrangement of the device are indicated.

Figure 1:
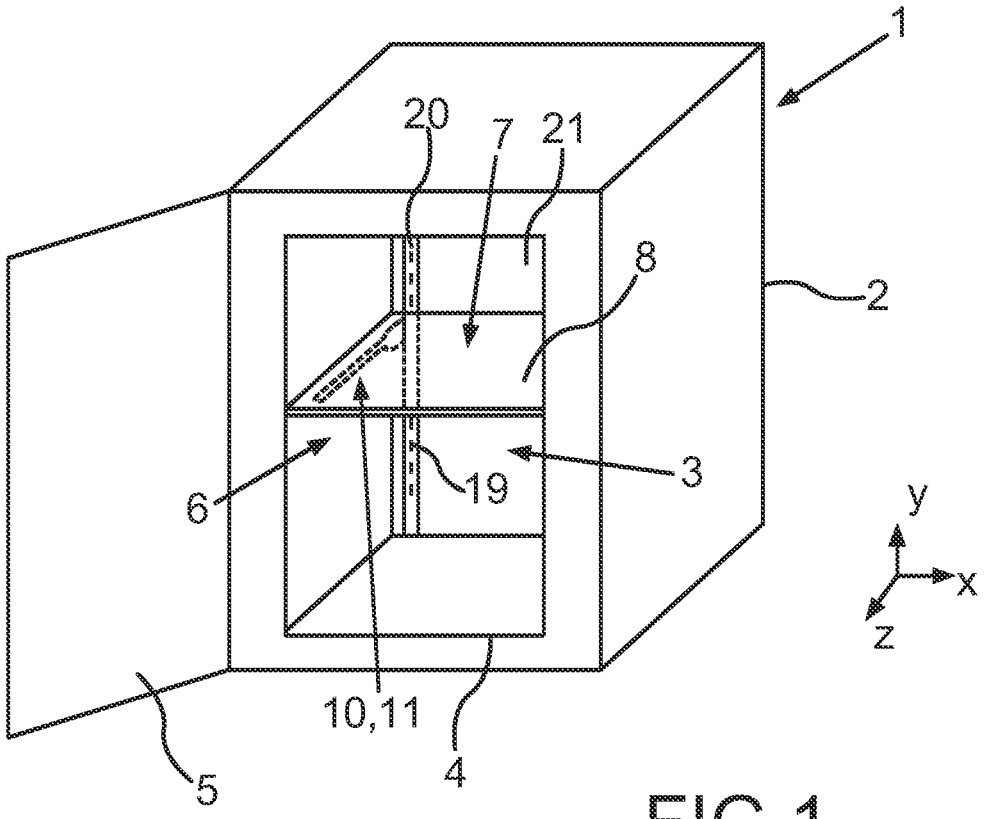
FIG. 1 is a simplified perspective view of an embodiment of a household cooling appliance according to the invention.

In FIG. 1 in a perspective view a household cooling appliance 1 is shown. The household cooling appliance 1 is configured for storing and preserving food. The household cooling appliance 1 can be configured as cooling appliance or as freezer device or as fridge freezer combination device. The household cooling appliance 1 comprises a housing 2. In the housing 2 at least one receiving space 3, or receptacle 3, for food is formed. The receptacle 3 can be a cooling compartment or a freezer compartment. The receptacle 3 is bounded by walls of an interior container 4. The interior container 4 comprises a charging opening at the front side. This charging opening is closable by a door 5 of the household cooling appliance 1. The door 5 is shown in FIG. 1 in the open state. The door 5 is arranged preferably pivotably on the housing 2. In particular the pivot axis is oriented in the height direction (y direction) of the household cooling appliance 1. Moreover, the household cooling appliance 1 comprises a shelf bottom device 6. The shelf bottom device 6 here is arranged in the receptacle 3 in its end position. The shelf bottom device 6 is configured for depositing or placing stored goods thereon. The shelf bottom device 6 comprises a plate-like shelf bottom 7. On a top face 8 of this shelf bottom 7 stored goods can be placed.

Figure 2:
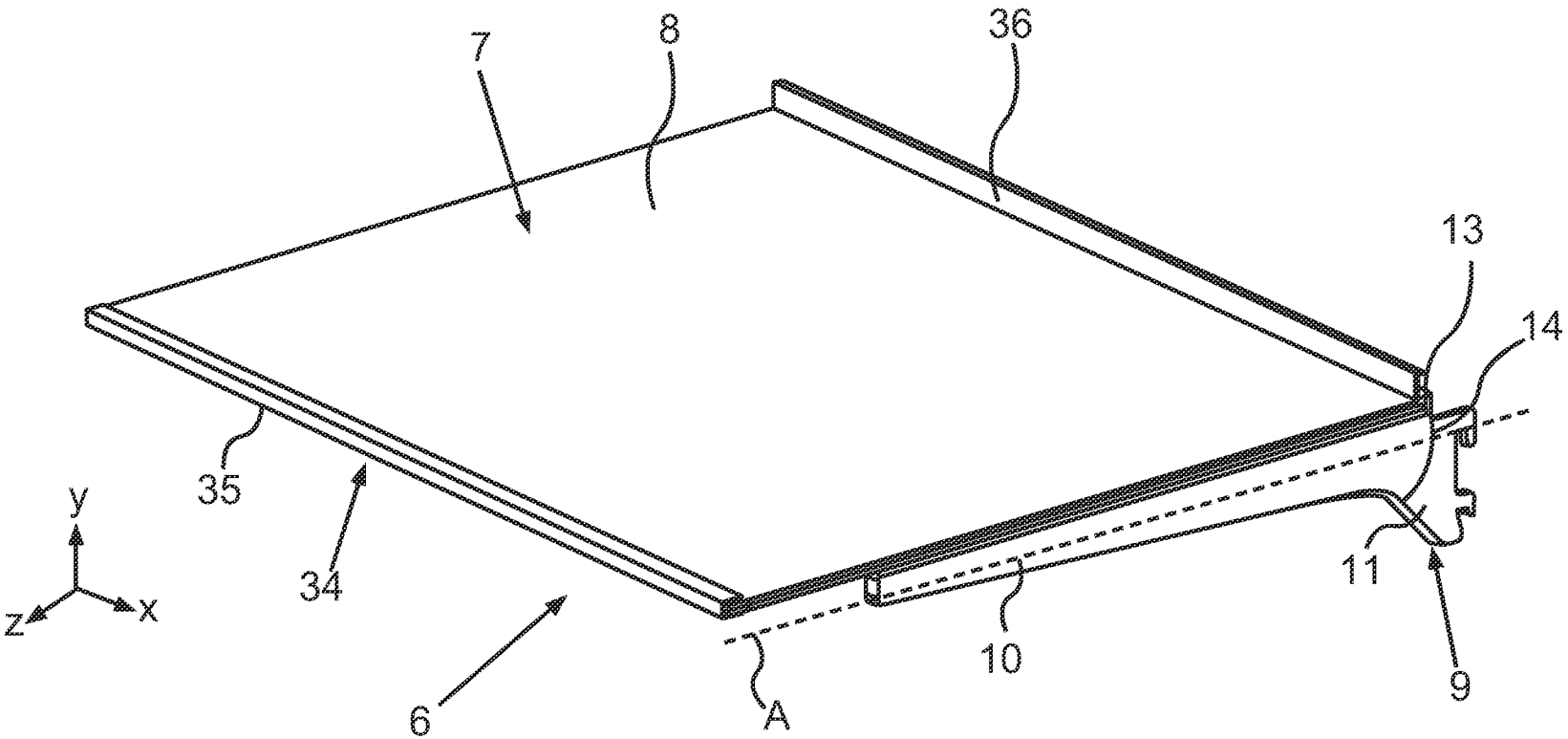
FIG. 2 is a perspective view of an embodiment of a shelf bottom device as it can be arranged in the household cooling appliance according to FIG. 1.

In FIG. 2 an embodiment of a shelf bottom device 6 is shown. The shelf bottom 7 can for instance be made from glass, in particular from real glass. The shelf bottom 7 can be configured to be at least partly transparent.

The shelf bottom device 6 moreover comprises a carrier unit 9, which is separate from the shelf bottom 7. Moreover, the shelf bottom device 6 comprises at least one separate receiving element 10, here in the embodiment two separate receiving elements 10.

Figure 3:
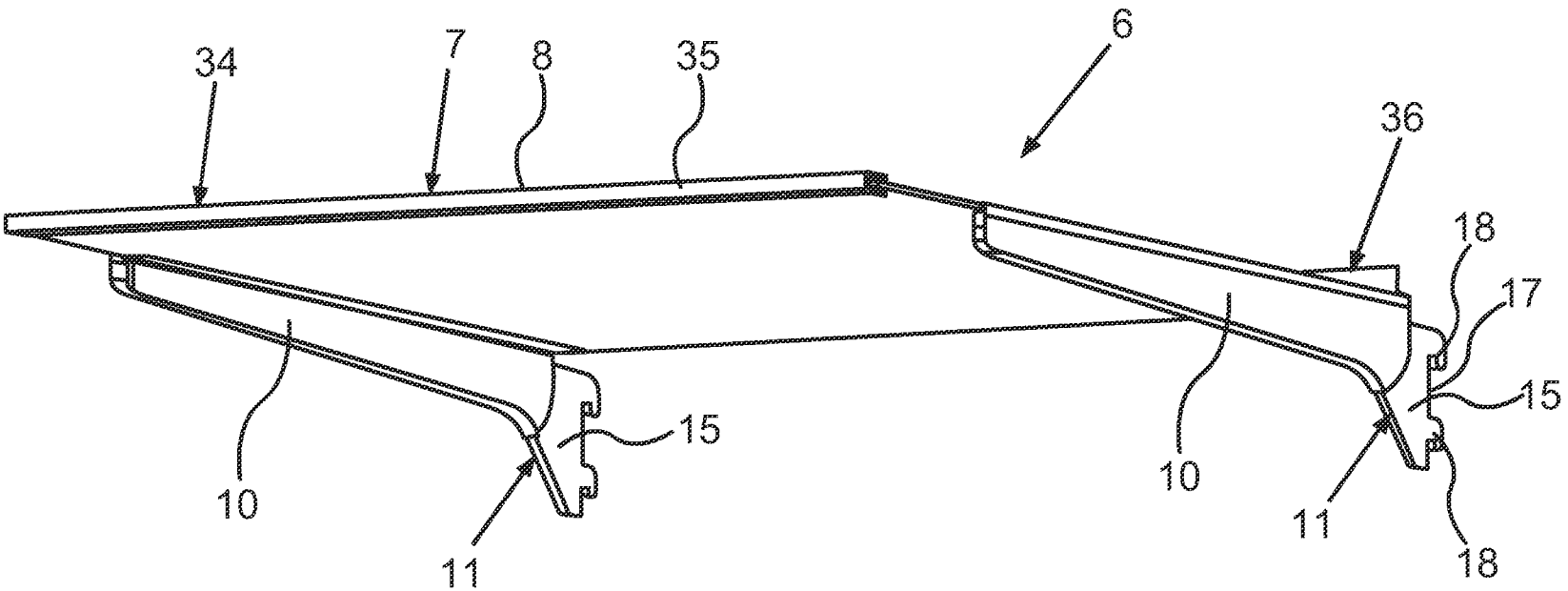
FIG. 3 is a representation of the shelf bottom device according to FIG. 2 in a perspective that is different thereto.

As can be seen in FIG. 2, the carrier unit 9 comprises a blade-like carrier arm 11. In particular, two such blade-like carrier arms 11 (FIG. 3) are comprised by the carrier unit 9. As can be seen in FIG. 2 and FIG. 3, in which the shelf bottom device 6 is shown in a perspective that is different from that of FIG. 2, the two separate receiving elements 10 are arranged in the width direction (x direction) of the shelf bottom device 6 and thus also the household cooling appliance 1 at opposite edge portions of the shelf bottom 7. The receiving elements 10, which are components that are separate from the shelf bottom 7 and from the carrier arms 11, each are in particular formed as single pieces. The receiving elements 10 can be configured to be made from plastic or metal or from a composite material. Also other material designs are possible.

Figure 6:
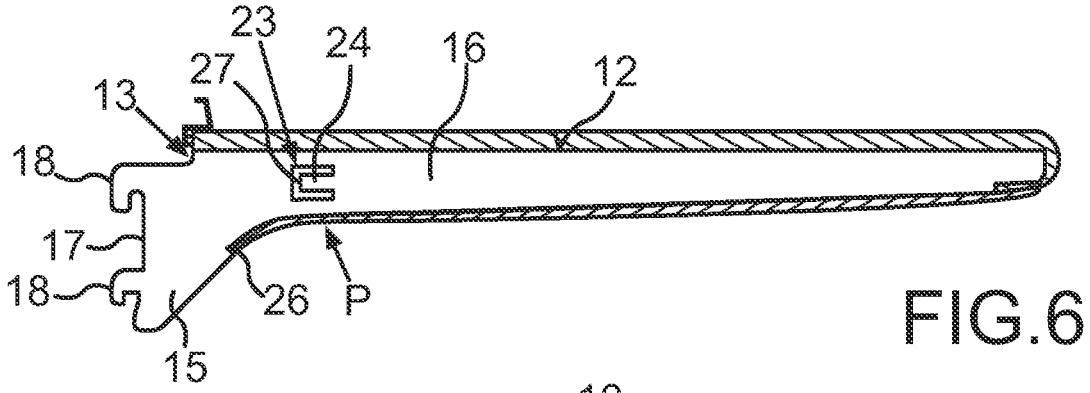
FIG. 6 is a sectional view through the components according to FIG. 4 in the mounted final state of these two components together.

The two receiving elements 10 are of the same design so that the following explanation is given based on one receiving element 10. As can be seen, the receiving element 10 is an elongated rail-like component. The receiving element 10 moreover is configured as hollow body. In this connection the receiving element thus comprises a hollow space 12 (FIG. 6). In particular the receiving element 10 is configured as blade sheath. In the direction of a longitudinal axis A of the receiving element 10, which is oriented in the depth direction (z direction) of the shelf bottom device 6 and thus of the household cooling appliance 1, the receiving element 10 on a rear end 13 comprises an insertion opening 14 for the carrier arm 11. The insertion opening 14 thus is also the entrance of the hollow space 12. On the front side the receiving element 10 is closed so that the hollow space 12 is configured practically as practically as a blind hole. This in particular slot-like hollow space 12 is configured for insertion or plugging-in of the carrier arm 11. In FIG. 2 and FIG. 3 the mounted final state between the carrier arms 11 and the receiving elements 10 is shown. As can be seen here a carrier arm 11 with a rear, broadened end piece 15 extends towards the back from the hollow space 12 so that a carrier arm 11 is not fully inserted into a receiving element 10.

As can be seen, a carrier arm 11 comprises a blade-like carrier arm front element 16, which in the mounted final state is inserted into the hollow space 12, in particular completely inserted.

As can already be seen in FIG. 2 and FIG. 3, a carrier arm 11 comprises a rear edge 17. This rear edge 17 is also the rear edge of the end piece 15. On the rear edge in particular two suspension hooks 18 are preferably formed as a single piece. With these suspension hooks 18 the shelf bottom device 6 can be suspended from a retention rail 20 (FIG. 1) oriented in the height direction, in particular from suspension slots 19 (FIG. 1) of the retention rail 20. The retention rail 20 can in particular be arranged on a rear wall 21 of the inner container 4. In particular two such retention rails 20 are mounted so that on opposite sides the—in the embodiment—two carrier arms 11 each can be suspended from one of these retention rails 20. The retention rail 20 is in particular a suspension rib.

Also a carrier arm 11 can be configured to be made from a different material and for instance be designed from metal. Equally, however, also a single-piece design from plastic or a composite material is possible.

Figure 4:
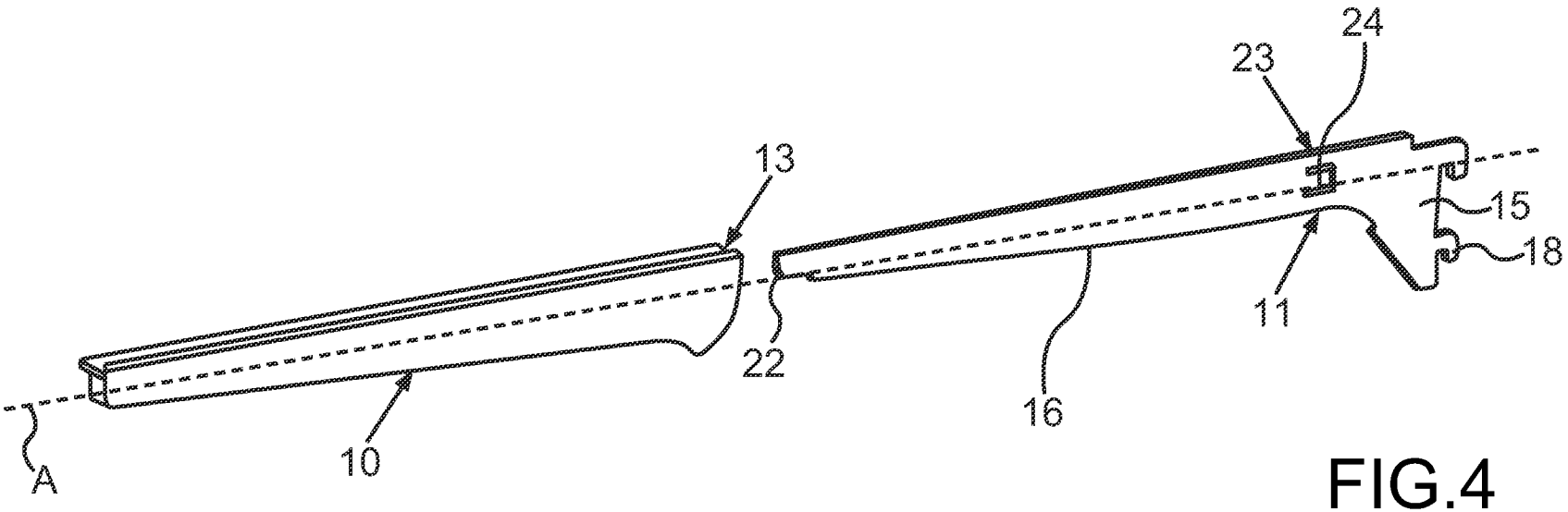
FIG. 4 is a perspective view of an embodiment of a carrier unit of the shelf bottom device and a receiving element of the shelf bottom device that is separate therefrom.

As can be seen in FIG. 4, in which a receiving element 10 and a carrier arm 11 that is separated therefrom are shown, the receiving element 10 viewed in the depth direction tapers towards the front. In particular also the blade-like carrier arm front part 16 is configured to be tapering towards a front end 22.

Advantageously, it is envisaged that a carrier arm 11 in the mounted final state in a receiving element 10 is fixed in position therein by a physical retention device or retention connection. In particular such a retention connection can be a latch connection 23. Such latch connection 23 for instance, as this is shown in FIG. 4, comprises a latch lug 24, which here is formed as a single piece with the carrier arm front element 16. This latch lug 24 can for instance be configured in the carrier arm front element 16 by way of clear cutting or punching out. It can additionally, as it is shown in an enlarged representation of a partial section of the carrier arm 11 in FIG. 5, be slightly bent out from the plane, in which the carrier arm 11 extends.

This latch lug 24 then latches with a latch element of the latch connection 23, which is formed in particular as a single piece within the hollow space 12.

Figure 5:
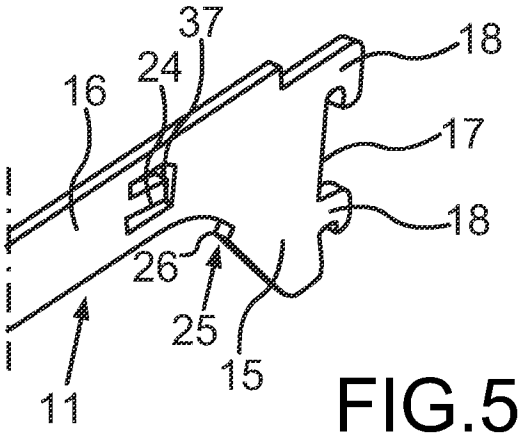
FIG. 5 is an enlarged view of a partial section of the carrier unit according to FIG. 4.

As can moreover be seen in the representations according to FIG. 4 and FIG. 5, the end piece 15 on a bottom edge 25 facing the carrier arm front element 16 preferably has a step 26. This step 26 serves as stop for the receiving element 10, as can be seen in FIG. 2 and FIG. 3. Thereby the inserted final state is additionally defined and too far an insertion of the carrier arm 11 into the receiving element 10, in particular into its hollow space 12, is thereby prevented.

Alternatively, according to the suggested representation in FIG. 5 also a latch slot 37 can be configured as punch-out in the carrier arm front element 16, in which a latch element latches in the hollow space 12 of the receiving element 10. The latch lug 24 then is not present.

In FIG. 6 in a sectional view the assembled final state between the carrier arm 11 and the receiving element 10 is shown. In FIG. 6 in this connection also the latch element 27 of the latch connection 23 is shown. Here the latch element 27 is configured as latch step or as latch edge and thus in particular as undercut in a wall of the receiving element 10 that bounds the hollow space 12.

Figure 7:
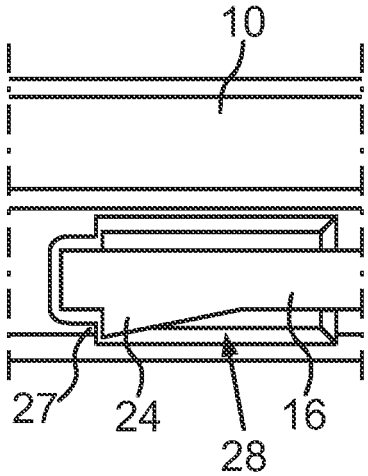
FIG. 7 is a partial view of FIG. 6 in a perspective from the bottom through an insertion opening.

In FIG. 7 a partial view of the connected state of the carrier arm 11 with the receiving element 10 according to FIG. 6 is shown. In particular here a view from the bottom (arrow P in FIG. 6) is shown. In FIG. 7 moreover also an insertion opening 28 can be seen, which is formed in a receiving element 10. By this insertion opening 28 in the receiving element 10 access to the retention device, in particular the latch connection 23, can be facilitated. The latched state can then, for instance be released by engaging with a release tool.

Figure 8:
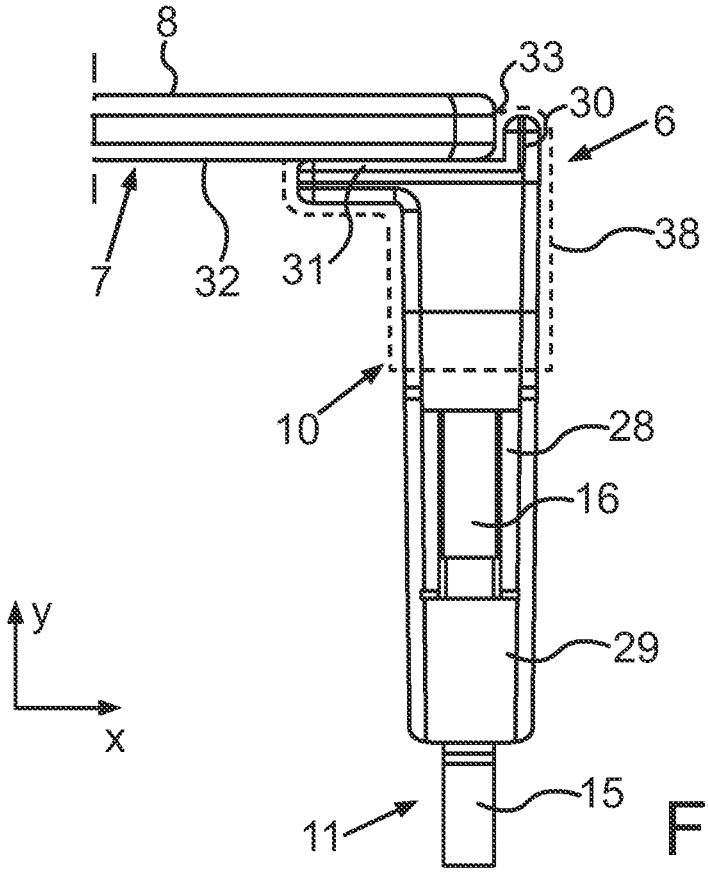
FIG. 8 is a frontal view upon a partial section of the shelf bottom device according FIG. 2.

In FIG. 8 a front view of the shelf bottom device 6 according to FIG. 2 and FIG. 3 is shown. The partial view, when viewed from the front, shows the right hand part of this shelf bottom device 6. In the example shown here on a bottom edge 29 of the receiving element 10 this insertion opening 28 is formed. The insertion opening 28 is different and separate from the insertion opening 14 on the rear end 13 of the receiving element 10.

Moreover, in FIG. 8 it can also be seen that in an advantageous embodiment the receiving element 10 comprises a width stop 30. This is preferably configured to be integrally formed in the receiving element 10. It preferably extends starting from a support plateau 31, which serves for supporting the shelf bottom 7, in the height direction upwards. As can be seen in FIG. 8, thus the shelf bottom 7 in the width direction is hindered by this width stop 30 in its freedom to move.

It may be envisaged that the shelf bottom 7 is glued with a bottom side 32 together with the receiving element 10, in particular with the support plateau 31.

However, it may also be envisaged that the shelf bottom 7 is connected with the receiving element 10 via a non-destructively releasable connection, for instance a plug connection. For this purpose the receiving element 10 may for instance comprise an integrated groove, in which the shelf bottom 7 is inserted, in particular plugged in, with its lateral portion, in particular a lateral edge 33.

In the embodiments according to FIG. 2 and FIG. 3 it may be envisaged that the shelf bottom device 6 additionally comprises a separate frame 34 (FIG. 2 and FIG. 3). This frame 34 can fully circumferentially surround the shelf bottom 7, can however, as shown in the example, be configured to be only partially encompassing. In the embodiment shown here separate straight frame elements 35 and 36, which, viewed in the depth direction, cover the front edge region of the shelf bottom 7 and a relative thereto rear edge of the shelf bottom 7, in particular across the entire width in each case. In particular the frame elements 35 and 36 are configured as rails with a groove, into which this front and rear edge of the shelf bottom 7 are arranged to plunge.

Moreover also additionally or instead lateral frame elements can be envisaged, which correspondingly cover the lateral edges of the shelf bottom 7, which are oriented in the depth direction. The frame 34 is configured as component that is separate from the receiving element 10.

It may preferably also be envisaged that the shelf bottom device 6 comprises a front side cover 38 as separate component. This is suggested in FIG. 8 by the dashed representation. It can be plugged upon the front end of the receiving element 10.

By such embodiment a non-destructively releasable connection between the components of the shelf bottom device is facilitated. Thereby the shelf bottom device can be separated for cleaning purposes and mounting purposes. Moreover, the stowability of this shelf bottom device, whilst it is not required and in particular taken out of the receiving space, is improved. Through this non-destructively releasable connection of several individual components of the shelf bottom device also in the state, in which it is not required, a disassembly can be effected and thus a more compact stowability be achieved.

Moreover the shelf bottom device is easier to be handled. For instance it may be envisaged that the shelf bottom device prior to insertion into the receiving space is entirely assembled and arranged as a whole in its end position in the receiving space. However, it may also be envisaged that for instance to start with the carrier unit is mounted in the receiving space and then attached with the then preferably already arranged receiving element on the carrier unit.

As advantageously not only the shelf bottom and the carrier unit are present, but additionally a separate receiving element is given, it is envisaged advantageously that the shelf bottom is no longer directly supported on the carrier unit or contacts same, but rather the receiving element is practically present as intermediate part. Thereby it can be avoided that the shelf bottom would be impaired by the carrier unit, for instance be scratched.

Advantageously the carrier unit is non-destructively releasably connected with the receiving element. Thereby the above-named advantages can be achieved in a particularly advantageous way. At this very interface between the carrier unit and the additional separate receiving element thus a particularly simple mounting and a safe positioning can be achieved and the shelf bottom contact be arranged in a contactless way without touching the carrier unit.

Preferably it is envisaged that the carrier unit comprises a blade-like carrier arm, which is introduced with a carrier arm front part into the hollow space. This blade-like carrier arm is advantageously configured to form a frontal free end and thus to be in particular tapered. Thereby construction space is saved and still the sufficient stability facilitated. By introducing this carrier arm front part into the hollow space same in the mounted state then is also safely retained and moreover positioned in a protected way. The receiving element thus quasi represents also a sleeve or a cover for the carrier arm, in particular the carrier arm front part. Moreover, by such embodiment a particularly stable connection between the carrier unit and the receiving element is facilitated.

Advantageously it is envisaged that the carrier arm front part is not only inserted into the hollow space, but also held therein in position by a physical retention device. This retention device can preferably be a latch connection. Thereby an undesired relative shifting between the carrier arm and the receiving element is avoided, if the carrier arm front part is introduced into the hollow space. An invariably safe arrangement of these two components in position relative to each other in the mounted state is thereby achieved. On the other hand, by this embodiment it is then also facilitated that this retention device is non-destructively releasable. Thereby, it can be reversibly be assembled and released.

Preferably it is envisaged that the latch connection comprises a latch lug that is integrally formed in the carrier arm front part and is latched in the mounted final state with a latch element of the latch connection, which is formed as a single piece with the receiving element in the hollow space. By the integrated design of the latch lug and the latch element with the components named in each case also a latch connection with a very reduced number of components is facilitated. Moreover, by this embodiment the latch element and the latch lug are arranged precisely in position on the respective components and a particularly stable and exact latching is also facilitated. This then is also sustained in the case of plural repetitions. Undesired tolerances can thereby be permanently avoided.

Preferably it is envisaged that in an alternative embodiment the latch connection comprises a latch punch-out that is integrally formed in the carrier arm front part and which is latched in the mounted final state with a latch element of the latch connection, which is formed as a single piece within the hollow space. This alternative embodiment, which with regard to the components is in particular inversely designed in comparison with the named embodiment, allows for the same advantages.

Depending on the respective shape of a carrier arm front part and/or the embodiment of the hollow space then these different concepts can be used individually and the respective individual advantages, in particular with regard to the manufacturability and/or due to the geometries of elements of the latch connection that can then in each case be generated in an advantageous and simpler way.

In an advantageous embodiment it is envisaged that the receiving element is configured as sheath for the blade-like carrier arm front part. Thereby a particularly safe and in particular also precisely fitting receiving of the carrier arm front part in the receiving element is rendered possible. Also in the end position then a secure retention of the carrier arm front part in this sheath is facilitated.

Moreover, in this connection quasi by a complete sheathing of the carrier arm front part by the receiving element this carrier arm front part is also protected to a particular extent, when it is introduced into the receiving element.

In an advantageous embodiment it may be envisaged that the receiving element is glued to the shelf. This is a very simple and yet stable and loadable non-destructively releasable connection.

It may also be envisaged that the receiving element is configured to be made from a material that is different from that of the shelf bottom. Precisely by this design of the shelf bottom device with this additional receiving element as separate part in this connection also material variants can be generated, in particular with regard to the shelf bottom and the receiving element, on the one hand, as well as with regard to the receiving element and the carrier unit, on the other hand. Thereby individual requirements as to stability, robustness against environmental influences, as well as undesired damages of adjacent material pairing can be optimally taken into consideration.

It may be envisaged that the receiving element is integrally formed from plastic. The receiving element, however, can also be formed as a single piece from metal. Equally, it is possible that the receiving element is formed as a single piece from a composite material.

In an advantageous embodiment the carrier unit can for instance be formed from plastic or from metal or from a composite material.

In an advantageous embodiment it is envisaged that the shelf bottom is configured to be made from real glass. The shelf bottom preferably can be configured to be transparent at least in portions.

In an advantageous embodiment it may be envisaged that the shelf bottom device additionally and as separate component comprises a frame, which surrounds the shelf bottom on the side of edge at least in portions and thus encloses it.

The frame can for instance be formed by a front face, straight, and in this connection in particular rail-like frame front part. This front part of the frame can cover a front edge or a front edge of the shelf bottom. Additionally or instead a rear part of the frame can be provided, which covers a rear edge or a rear rim of the shelf bottom. Also it is possible that additionally or instead lateral frame elements are provided, which enclose the lateral edges or frames of the shelf bottom. These lateral frame elements are in particular also components that are separate from the receiving element.

In an advantageous embodiment it is envisaged that the receiving element viewed in the depth direction of the household cooling appliance is oriented in this depth direction and on a side portion of the shelf bottom is connected with same. In this connection it may be envisaged that this receiving element instead of a glue connection is connected with the shelf bottom by a plug connection. For instance the receiving element can comprise a groove, into which the shelf bottom is introduced with its edge or rim that is oriented in the depth direction. By such a design the receiving element then additionally is also an edge protection at the same time. The receiving element is in particular a longitudinal component, which viewed in the height direction extends from the shelf bottom downwards. In the mounted state thus this receiving element is oriented at least in portions below the shelf bottom. In the mounted state of the carrier unit on the receiving element advantageously also this carrier unit, in particular the carrier arm, viewed in the height direction is positioned below the shelf bottom. Thereby the top face of the shelf bottom is not impaired by these additional components and the full surface is available for depositing stored goods.

Preferably, the receiving element comprises an insertion opening, through which a retention connection, which is configured for retaining the carrier unit within the receiving element, in the hollow space of the receiving element is accessible and releasable. In particular in this connection a latch connection between the carrier unit and the receiving element is accessible and releasable through this insertion opening. For instance it can be facilitated that via this insertion opening a release tool can be inserted and the named retention connection released.

The receiving element comprises an insertion opening of the hollow space, via which the carrier unit can be introduced into the hollow space. In particular this insertion opening is an opening that is different from the above-named insertion opening and separate and spaced apart from it.

Preferably, it is envisaged that the insertion opening in the direction of a longitudinal axis of the receiving element is formed on a rear end of the receiving element.

In particular it is envisaged that the insertion opening viewed in the height direction is formed on a bottom edge of the receiving element.

In an advantageous embodiment it is envisaged that the carrier unit on a rear edge comprises at least one suspension hook, with which the carrier unit is capable of being non-destructively releasably suspended from a suspension rib of the household cooling appliance that is separate therefrom. This suspension rib can for instance be arranged on a rear side bounding the receptacle.

In an advantageous embodiment the shelf bottom device comprises a separate cover, which is non-destructively releasably attached on a front end of the receiving element for covering the receiving element on the front side.

In particular when a latch lug is formed as a single piece in the carrier arm front part, this can be effected for instance by a punch-out process and the cut-out produced then in this way, by which the geometry of the latch lug is then defined, be generated. This latch lug can then preferably by a bending operation be bent out slightly from this plane, in which the carrier arm front part extends, so that then the latching with the latch element formed in the hollow space can be effected particularly effectively. Thereby for instance also a certain spring effect of this latch lug can be generated.

If in the hollow space, in particular on a wall of the receiving element bounding the hollow space a protruding latch element is formed, for instance a latch edge or a latch step, same can be configured in particular also as undercut.

In a further advantageous embodiment it is envisaged that the receiving element is configured to be integrated and thus formed as a single piece with it comprises a stop for the shelf bottom. By this stop the shelf bottom the movement of the shelf bottom viewed in the width direction of the household cooling appliance and thus also the shelf bottom device is limited, in particular avoided. An undesired shifting of the shelf bottom in this width direction relative to the receiving element is thereby avoided.

Further features of the invention are apparent from the claims, the figures and the description of figures. The features and feature combinations mentioned above in the description as well as the features and feature combinations mentioned below in the description of figures and/or shown in the figures alone are usable not only in the respectively specified combination but also in other combinations, without departing from the scope of the invention. Thus, implementations are also to be considered as encompassed and disclosed by the invention, which are not explicitly shown in the figures and explained, but arise from and can be generated by separated feature combinations from the explained implementations. Implementations and feature combinations are also to be considered as disclosed, which thus do not comprise all of the features of an originally formulated independent claim. Moreover, implementations and feature combinations are to be considered as disclosed, in particular by the implementations set out above, which extend beyond or deviate from the feature combinations set out in the back-references of the claims.

LIST OF REFERENCE SIGNS

1 household cooling appliance
2 housing
3 receptacle, receiving space
4 inner container

5 door
6 shelf bottom device
7 shelf bottom
8 top face
9 carrier unit
10 receiving element
11 carrier arm
12 hollow space
13 rear end
14 insertion opening
15 end piece
16 carrier arm front element
17 rear edge
18 suspension hooks
19 suspension slots
20 retention rail
21 rear wall
22 front end
23 latch connection
24 latch lug
25 bottom edge
26 step
27 latch element
28 engagement opening
29 bottom edge
30 width stop
31 support plateau
32 bottom face
33 lateral edge
34 frame
35 frame element
36 frame element
37 latch slot
38 cover
P arrow

The invention claimed is:

1. A household cooling appliance, comprising:

a housing with a receptacle for food;

a shelf bottom device, which is positionable in a non-destructively releasable way in the receptacle;

the shelf bottom device including a plate-shaped shelf bottom and a carrier unit separate therefrom, wherein the carrier unit is connected with the shelf bottom and is configured for retention of the shelf bottom device in the receptacle, the carrier unit including a blade-shape carrier arm having a top, a bottom, sides and a carrier arm front part;

the shelf bottom device including at least one receiving element with a hollow space, which is arranged on the shelf bottom, the receiving element being a sheath receiving and surrounding the top, the bottom, and the sides of the blade-shape carrier arm;

the carrier arm front part being insertable via an access opening of the hollow space into the hollow space by insertion along a longitudinal direction of the carrier arm;

a latch connection retaining the carrier arm front part in the hollow space;

in a mounted final state the carrier unit is introduced at least partly into the hollow space.

2. The household cooling appliance according to claim 1, wherein the carrier unit is connected in a non-destructively releasable way with the receiving element.

3. The household cooling appliance according to claim 1, wherein the latch connection comprises a latch lug, which is integrally formed in the carrier arm front part and in the mounted final state is latched with a latch element of the latch connection, which is formed in the hollow space as a single piece with the receiving element.

4. The household cooling appliance according to claim 1, wherein the latch connection comprises a punch-out, which is integrally formed in the carrier arm front part and in which in the mounted final position a latch element of the latch connection is latched, which is integrally formed in the hollow space.

5. The household cooling appliance according to claim 1, wherein the receiving element is glued or plugged to the shelf bottom.

6. The household cooling appliance according to claim 1, wherein the receiving element is configured to be made from a material that is different from the shelf bottom.

7. The household cooling appliance according to claim 1, wherein the receiving element is configured as a single piece from plastic or metal or a composite material.

8. The household cooling appliance according to claim 1, wherein the shelf bottom is configured to be made from real glass.

9. The household cooling appliance according to claim 1, wherein the receiving element is oriented in the depth direction of the household cooling appliance and is connected with the household cooling appliance at a lateral portion of the shelf bottom.

10. The household cooling appliance according to claim 1, wherein the receiving element comprises an engagement opening, through which a retention connection, in particular a latch connection between the carrier unit and the receiving element in the hollow space is accessible and releasable.

11. The household cooling appliance according to claim 1, wherein the carrier unit at a rear edge comprises at least one suspension hook, with which the carrier unit is capable of being suspended in a non-destructively releasable way from the retention rail of the household cooling appliance, which is arranged in the receptacle.

12. The household cooling appliance according to claim 1, wherein the shelf bottom device comprises a separate cover, which is attached to a front end of the receiving element for covering the receiving element at the front face in a non-destructively releasable way.

* * * * *